US005236234A

United States Patent [19]

Norman

[11] Patent Number: 5,236,234

[45] Date of Patent: Aug. 17, 1993

[54] VEHICLE DOOR LATCHES

[75] Inventor: Alan E. Norman, Solihull, England

[73] Assignee: Rockwell Automotive Body Systems (U.K.) Limited, Great Britain

[21] Appl. No.: 868,776

[22] Filed: Apr. 15, 1992

[30] Foreign Application Priority Data

Apr. 19, 1991 [GB] United Kingdom ..... 9108447

[51] Int. Cl.[5] ..... F05C 3/26

[52] U.S. Cl. ..... 292/201; 292/216

[58] Field of Search ..... 292/201, 337, 216, 280, 292/DIG. 23, DIG. 26

[56] References Cited

U.S. PATENT DOCUMENTS

| | | | |
|---|---|---|---|
| 4,452,058 | 6/1984 | Noel | 70/137 |
| 4,518,182 | 5/1985 | Cousin et al. | 292/201 |
| 4,624,491 | 11/1986 | Vincent | 292/201 |
| 4,876,909 | 10/1989 | Andrei-Alexandru | 74/50 |
| 4,898,414 | 2/1990 | Yamada | 292/201 X |
| 4,948,183 | 8/1990 | Yamada | 292/201 X |
| 4,978,153 | 12/1990 | Hirsch et al. | 292/201 |
| 4,979,384 | 12/1990 | Malesko et al. | 292/201 X |
| 5,072,975 | 12/1991 | Hamada et al. | 292/201 |

FOREIGN PATENT DOCUMENTS

| | | |
|---|---|---|
| 8801334 | 2/1988 | Fed. Rep. of Germany . |
| 0364936 | 4/1990 | Fed. Rep. of Germany . |
| 0059658 | 9/1982 | France . |
| 0099820 | 2/1984 | France . |
| 0153231 | 8/1985 | France . |
| 2256030 | 6/1991 | France . |
| 2178475 | 2/1987 | United Kingdom . |
| 2207698 | 2/1989 | United Kingdom . |
| 2227049 | 7/1990 | United Kingdom . |

*Primary Examiner*—Richard E. Moore

*Attorney, Agent, or Firm*—Learman & McCulloch

[57] ABSTRACT

Unitary integrated door latch assembly for vehicles, best seen in FIG. 1, has retention mechanism including a rotary or other latch bolt which engages a door post striker locking mechanism for locking and unlocking the retention mechanism, and electrical actuation and switching means for remote operation of the assembly and/or operation of latch assemblies of other doors of the vehicle e.g. as part of a central locking system, the assembly being in the form of a unit having a body or housing containing at least the electrical components and preferably also the mechanical components substantially sealed for protection and to resist tampering, and with electrical circuitry moulded into the body for plug-in connection of actuators, switches and other electrical components and for plug-in connection to external circuitry, the housing accommodating various selections of electrical components so that a common standard unit can be readily adaptable to different modes or systems of operation e.g. to provide a super-locking facility if required.

12 Claims, 6 Drawing Sheets

VEHICLE DOOR LATCHES

BACKGROUND OF THE INVENTION

1. Field of the Invention

This invention relates to vehicle door latches incorporating locking mechanism for securing the vehicle against unauthorised entry. More specifically the invention relates to said door latches incorporating an electrically powered actuating facility for remote operation of the latch by a central locking system of the vehicle and, preferably, incorporating a selectively operable powered superlocking facility whereby the latch cannot be freed from a locked condition even if an intruder gains access to latch actuating elements within the vehicle e.g. the interior door handle or sill button as by breaking a window or probing into or through the door. The latter facility is variously referred to as "deadlocking" or "double locking" in some other contexts but the term "superlocking" will be used herein.

2. Description of the Prior Art

Examples of known latches having these facilities are described inter alia in our patents or patent applications GB 2 207 698 and equivalent EP 0 302 642 and U.S. Pat. No. 4,986,098; and in GB -A-2 227 049 and equivalent EP-A-0379273.

SUMMARY OF THE INVENTION

The object of the present invention is to provide a vehicle latch which is economical and simple to manufacture and install, durable and reliable in use, which provides a high standard of security against unauthorised entry to the vehicle, and which is readily operable or adaptable to be operated in a variety of centrally operated or other control modes.

According to the invention there is provided a vehicle door latch assembly including retention mechanism having a latch bolt operatively co-acting with a door post striker for latching the door in use, locking mechanism selectively operable to lock and unlock the retention mechanism, a primary electric actuator linked for selective powered operation of the locking mechanism, and an electrical circuit connected with said actuator: characterised in that the assembly further comprises a body locating the retention mechanism, the locking mechanism, the actuator, and the circuit in their operative relationship and formed to accommodate one or more additional electric components in operative connection to said circuit; a housing part of said body containing at least the actuator, the circuit, and any said additional electric component or components for installation of the assembly as a single unit with at least all electric elements of the assembly substantially protected within said housing part.

An example of the invention is now more particularly described with reference to the accompanying drawings wherein

DETAILED DESCRIPTION OF THE PREFERRED EMBODIMENT

The complete latch is designed as an integrated unit incorporating manual and power actuation components and their immediately related circuitry, and switching for the latter, in a single assembly with plug-in electrical connection to external circuitry so that it can readily and speedily be installed on the assembly line or if replacement is needed in service e.g. due to accident damage.

Figure 2:
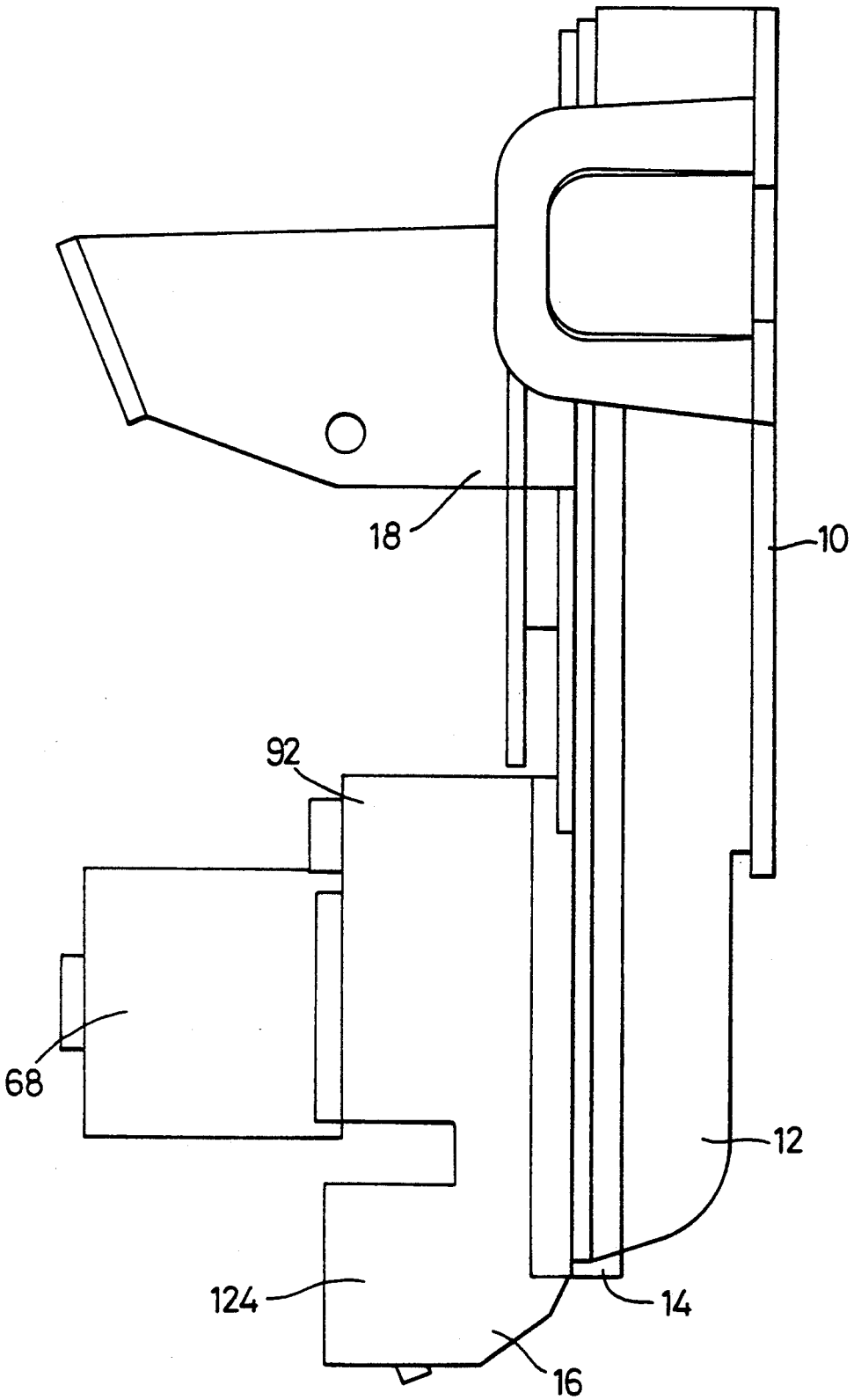
FIG. 2 is a sectional end view corresponding to FIG. 1.
Figure 3:
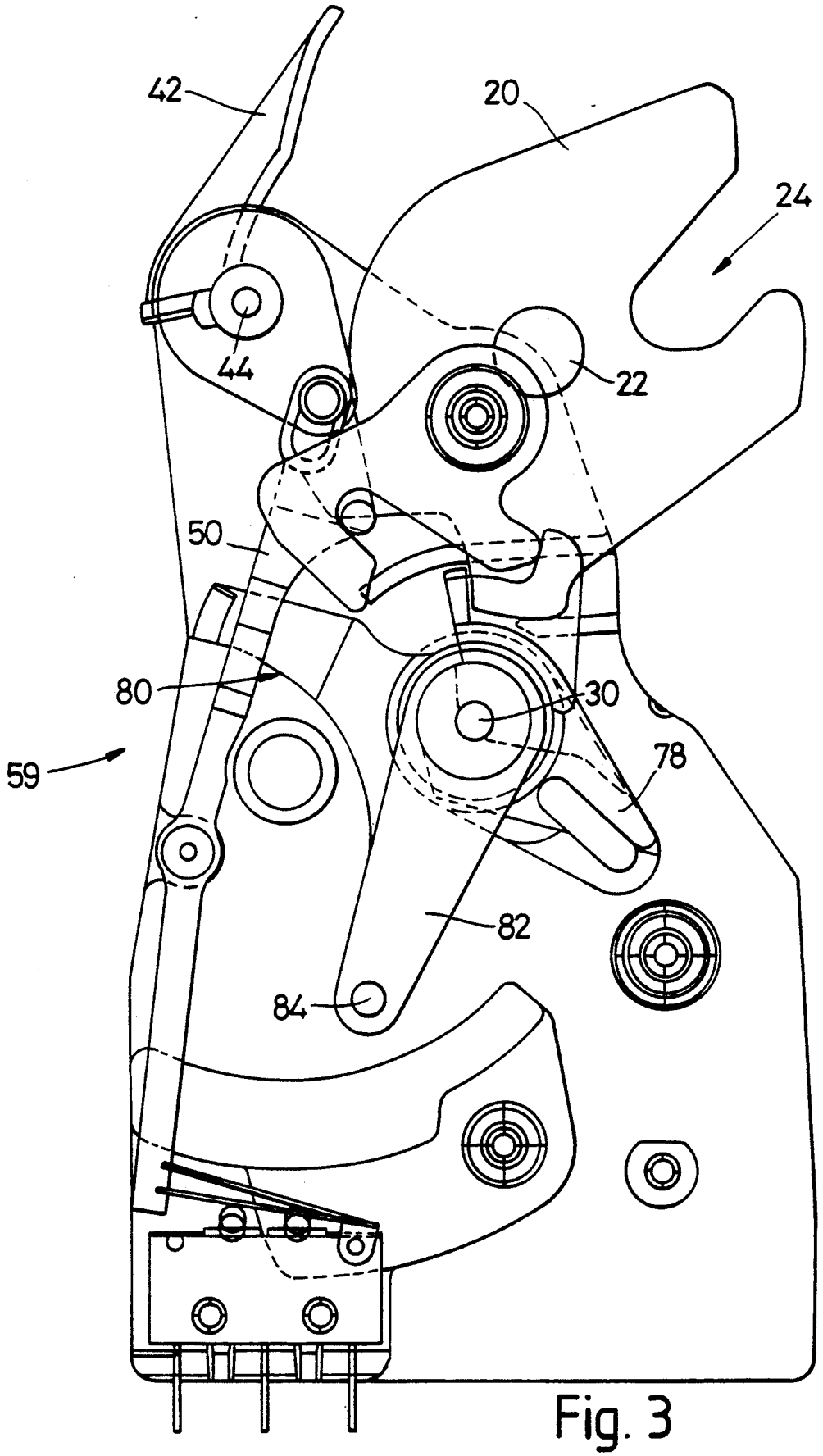
FIG. 3 is a side view of the retention mechanism and related components.

Thus, the body of the latch which locates and contains the components of the mechanism comprises a retention plate 10 which locates and contains retention mechanism referred to hereafter, a main body shell 12, a body cover 14, an outer moulding 16 and a metal back plate 18 which are assembled and secured together in sandwich fashion as shown in FIG. 2.

The locking and superlocking mechanism of the latch is contained within a housing chamber defined by shell 12 and cover 14 which is sealed against ingress of dirt and moisture.

Figure 1:
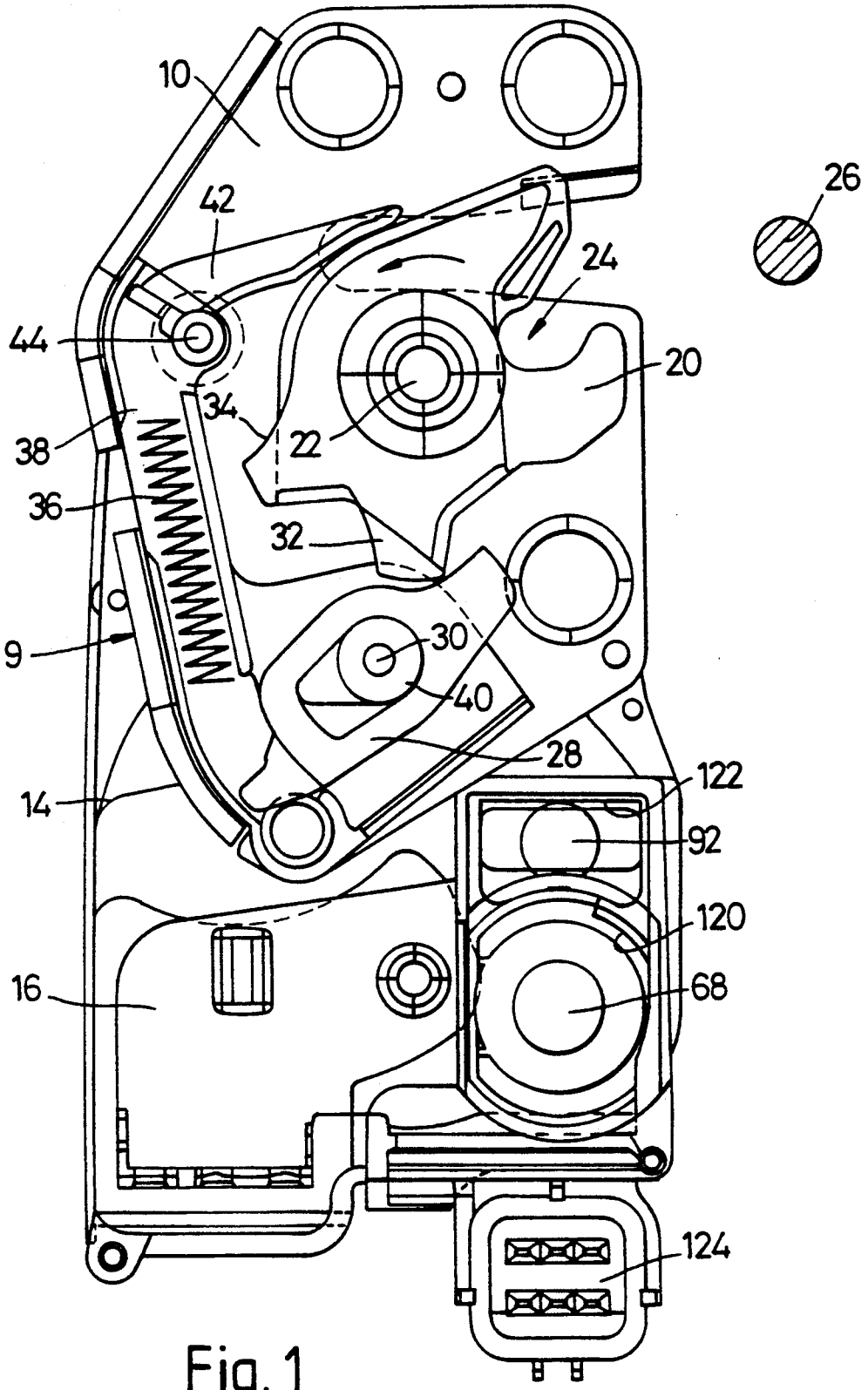
FIG. 1 is a sectional side elevation of retention mechanism and other parts of a vehicle door latch assembly.

The retention mechanism 9 located in and by retention plate 10 is best seen in FIG. 1 and comprises a latch bolt in the form of a latch claw 20 mounted rotatably on a claw rivet 22 and defining a mouth 24 for coupling with a cylindrical portion of a striker formation shown diagrammatically at 26 in FIG. 1 which will be mounted on the vehicle door post in conventional manner. It is to be understood that a form of claw or other bolt cooperating with other forms of striker, e.g. a wedge type striker, could be used as is known in the art.

Claw 20 is formed from metal but is provided with a coating or partial coating of plastics material, in particular the jaw portions defining mouth 24 are provided with plastics facing having a degree of resilience which will accommodate any slight misalignment or manufacturing tolerances and wear to provide snug and substantially rattleproof engagement with the striker 26.

A claw pawl 28 is located on a stud 30 for angular movement into and out of engagement with angularly spaced locating faces 32, 34 of claw 20 to retain the latter at door ajar and door fully secured positions in known manner, the pawl being resiliently biased towards the claw e.g. by a torsion spring so that the formations 32, 34 can snap past the pawl during counter-clockwise rotation of the claw as viewed in FIG. 1, i.e. during closing of the door.

A compression spring 36 located in a spring housing 38 biases claw 20 in the clockwise direction i.e. for its positive engagement with the retention pawl, the biasing force being applied through a claw position lever 42 as referred to below.

Pawl 28 is not directly journalled on stud 30, a pawl drive dog 40 is received directly on stud 30, an elongated aperture of the pawl locating thereon, the coacting part of dog 40 being shaped to provide lost motion connection with the pawl. Thus selective angular displacement of dog 40 by the latch mechanism will carry pawl 28 out of engagement with claw 20 to free the latter for opening of the door but motion transmitted to pawl 28 from claw 20 on closing the door as referred to above is not transmitted to or through dog 40. This substantially reduces inertia and resistance to movement of pawl 28 as the door is closed and also eliminates any free wheeling motion of the latch mechanism associated with dog 40 during door closing so providing effective and positive pawl action and reducing noise and wear and tear on the latch mechanism as the door is slammed or otherwise shut.

Figure 5:
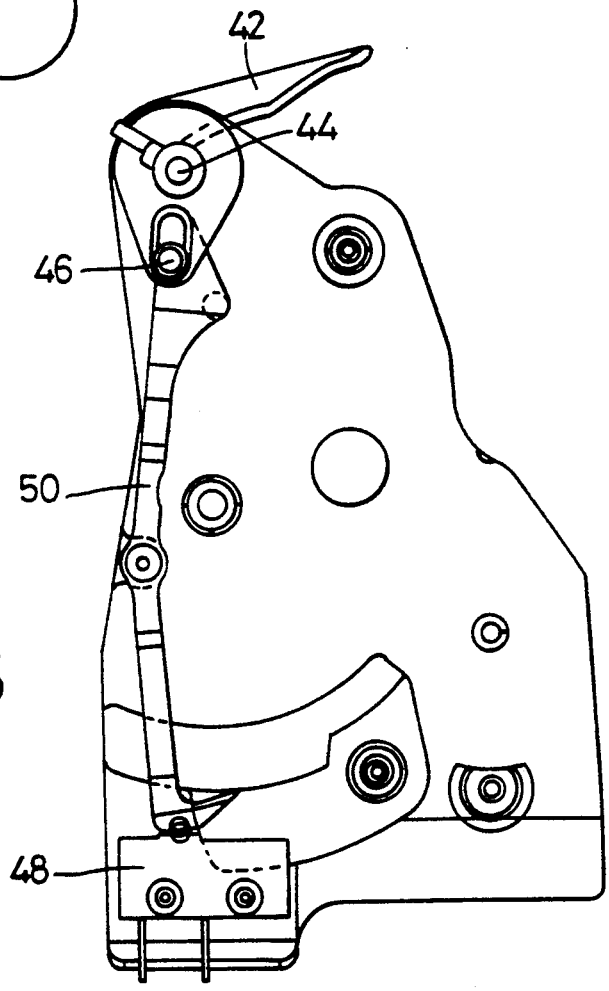
FIGS. 5, 6 and 7 illustrate the incorporation of respective electrical operating and monitoring switches in the latch.

The claw position lever 42 referred to above is pivoted on a stud 44 carried on an end portion of spring housing 38 and has an arm bearing on a face of claw 20 remote from formations 32, 34 urging the claw clockwise as viewed in FIG. 1. This lever also serves to sense the angular position of the claw, a crank pin 46 (FIG. 5) thereon being linked to open and close a door ajar switch 48 by means of a connecting lever 50 within the main housing. Switch 48 provides a warning signal through an appropriate circuit provided on the vehicle indicating, e.g. visually by means of a warning light, that a door is not fully closed.

Also located within the body chamber is the manually and power actuated locking mechanism 59 which controls displacement of pawl 28 to free claw 20 to unlock and/or open the associated door.

Firstly, substantially conventional manually actuated locking mechanism is provided for operation of the latch directly from the actuating elements of the associated door assembly. With the latch in unlocked condition respective linkage between the inside and outside door handles operates pawl 28 by displacement of dog 40 for opening the door. Locking the door manually disables unlatching by means of the external door handle, said locking being effected by a conventional push-pull sill button and/or by means of a key actuated lock cylinder on the outside of the door in known manner. Components of these parts of the mechanism are not described in detail except as incidental to other aspects of the construction and operation. Apart from the linkages or other connections to the door handles, sill button, and lock cylinder this locking mechanism is sealed within the housing.

Figure 4:
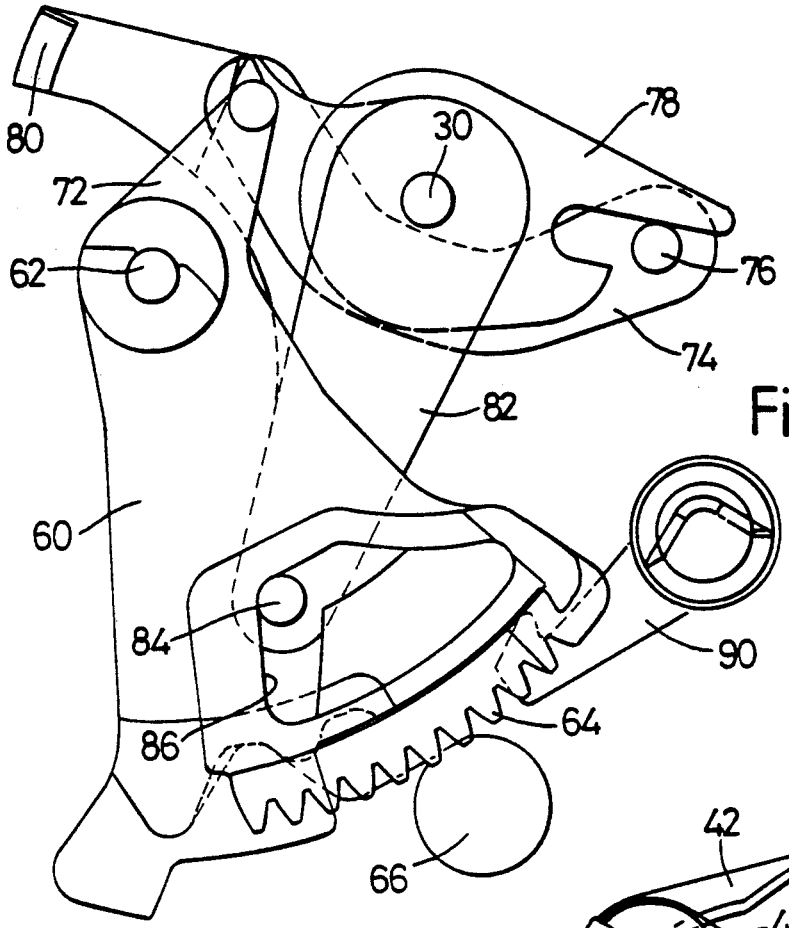
FIG. 4 is a side view of power actuated locking and superlocking components of the latch.

Referring particularly to FIG. 4 located within said housing is a locking quadrant 60 fulcrummed on a quadrant stud 62. A toothed sector 64 of the quadrant is engaged by a drive pinion 66 of a primary actuator being an electrically powered locking actuator motor 68 (FIGS. 1 and 2), its connection to pinion 66 being through a self-acting clutch assembly of known kind. An arm 72 of quadrant 60 is pivotally connected to a clutch link 74 for longitudinal displacement of the latter between engaged and disengaged conditions. In the engaged condition a drive pin 76 at the end of link 74 remote from arm 72 engages in a mating slot of a pawl lifting piece 78. Lifting piece 78 is pivoted co-axially with pawl 28 for angular movement about the axis of pawl stud 30. FIG. 4 shows the disengaged position, pin 76 being out of said slot.

A sill button bell crank lever 80 is also pivoted co-axially with stud 30 and includes a downwardly depending arm 82 mounting a pin 34 which projects into a window 86 defined in quadrant 60. Window 86 is shaped to prevent or limit angular movement of crank 80 and/or to transmit angular drive therebetween in predetermined paths and positions.

With the mechanism in the engaged condition sill crank 80 is drivingly connected to pawl lifting piece 78 by the pin 76 on clutch link 74 thus either door handle can be operated to shift pawl 28 for opening of the door from the interior or exterior of the vehicle. With quadrant 60 displaced angularly clockwise from its extreme engaged position, pin 76 is shifted to the right as viewed in the drawings out of engagement with lifting piece 78 thus disconnecting the door handles for any movement of the pawl. It will be noted that in this condition the sill lever 80 and hence the associated sill button is in a "free-wheeling" condition i.e. they can still be displaced but without any effect on the remaining mechanism. This has the advantage that any attempt to unlock the latch by probing inside the door to engage the sill button or its connecting link to lever 80 will have no effect even if movement thereof takes place or bending or pulling forces are applied thereto in an attempt to force the latch. Similarly forcing the door handle or engaging or forcing their linkage with the latch will have no effect.

The locked condition of FIG. 4 can be obtained by manual operation of a key in the key cylinder of the door or by remote actuation e.g. as part of a central locking system of the vehicle, by powering motor 68 for the requisite movement.

A pivoted super-lock inhibiting hook 90 is normally resiliently urged to the positions shown in FIG. 4 at which it engages an abutment on quadrant 60 to limit its displacement in said clockwise direction so determining the position of FIG. 4 where the door is in the normally locked condition.

To effect super-locking a signal is passed to a separate secondary actuator being a super-lock motor 92 (FIGS. 1 and 2) which rotates hook 90 anti-clockwise away from quadrant 60 thus freeing the quadrant for motor 68 to drive it further clockwise beyond the FIG. 4 position to a super-locking position. In this position the latch is doubly secured in that it cannot be actuated by either door handle or the sill button. The sill button is disengaged to the free wheeling condition and the pawl drive dog 40 (FIG. 1) is positively retained with pawl 28 engaged with claw 20, thus the latch is rendered fully inoperable while the superlocked condition is maintained.

It will be noted that super-locking motor 68 need only be energised to shift hook 90 away from quadrant 60 i.e. it only needs to be powered momentarily during the superlocking process. It is not used for shifting any superlocking member into a blocking condition or maintaining the latch mechanism in a blocked or locked up state. Thus the superlocking motor can be a small low powered unit and its related mechanism is not subjected to any loading by the mechanism or locking forces.

Figure 6:
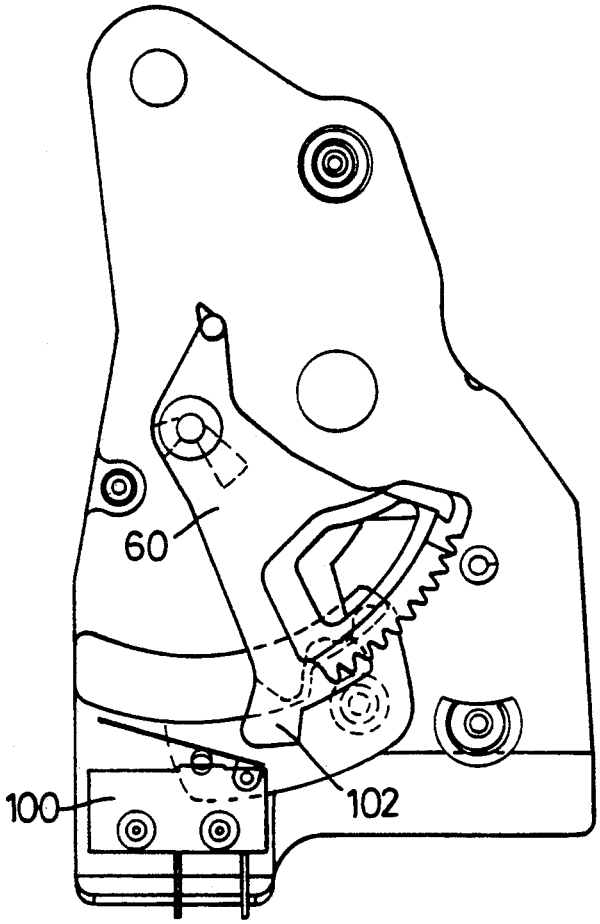
Figure 7:
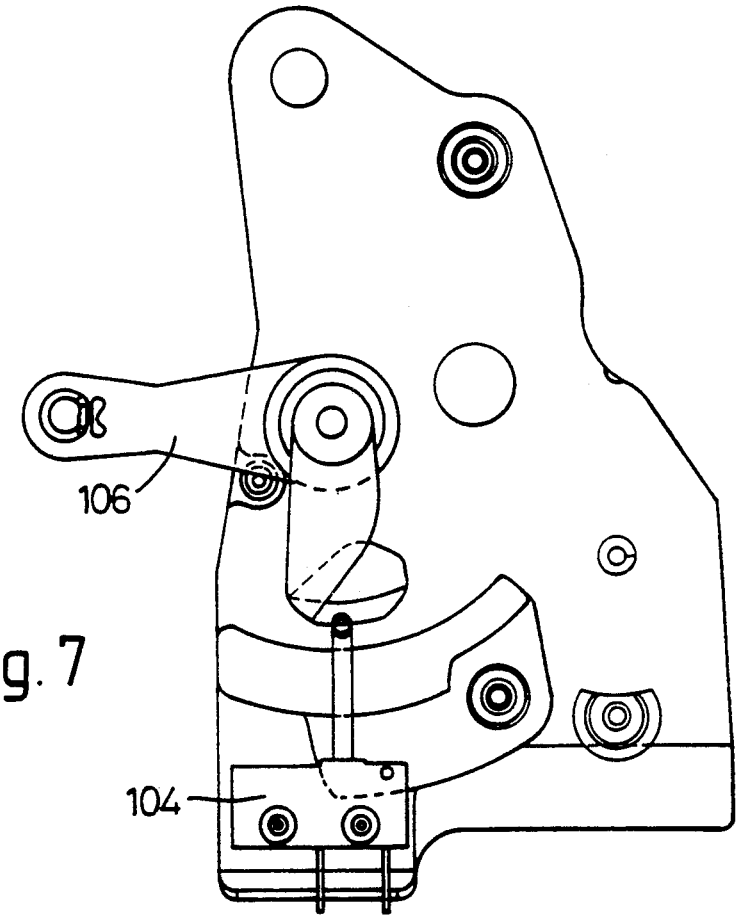

As well as the integration of door condition sensing switch 48 into the assembly further switches of the central operating system are also integrated therewith, for example as shown in FIGS. 6 and 7. In FIG. 6 a central deadlocking switch 100 is located to co-act with an operating formation 102 on quadrant 60 when the latter is shifted to the superlocked position. This provides a signal for automatically superlocking all other locks on the vehicle fitted with this facility when a lock having this switch is itself superlocked e.g. by use of the key in the relevant door lock cylinder. In FIG. 7 a switch 104 responsive to operation of the key in said lock cylinder is also integrated with the latch by being actuated in response to angular movement of key lever 106. Provision of integrated switches in this way eliminates the need to provide any switches or electrical circuitry associated with the key cylinder itself, thus avoiding the inconvenience of having to instal switches and connect wiring thereto within the door and also better protecting the switches and the associated circuitry from damp and dirt, indeed, as the switches are sealed within the latch housing for full protection they can be lighter duty components which are less costly and smaller in size whilst still assuring reliable operation.

Figure 8:
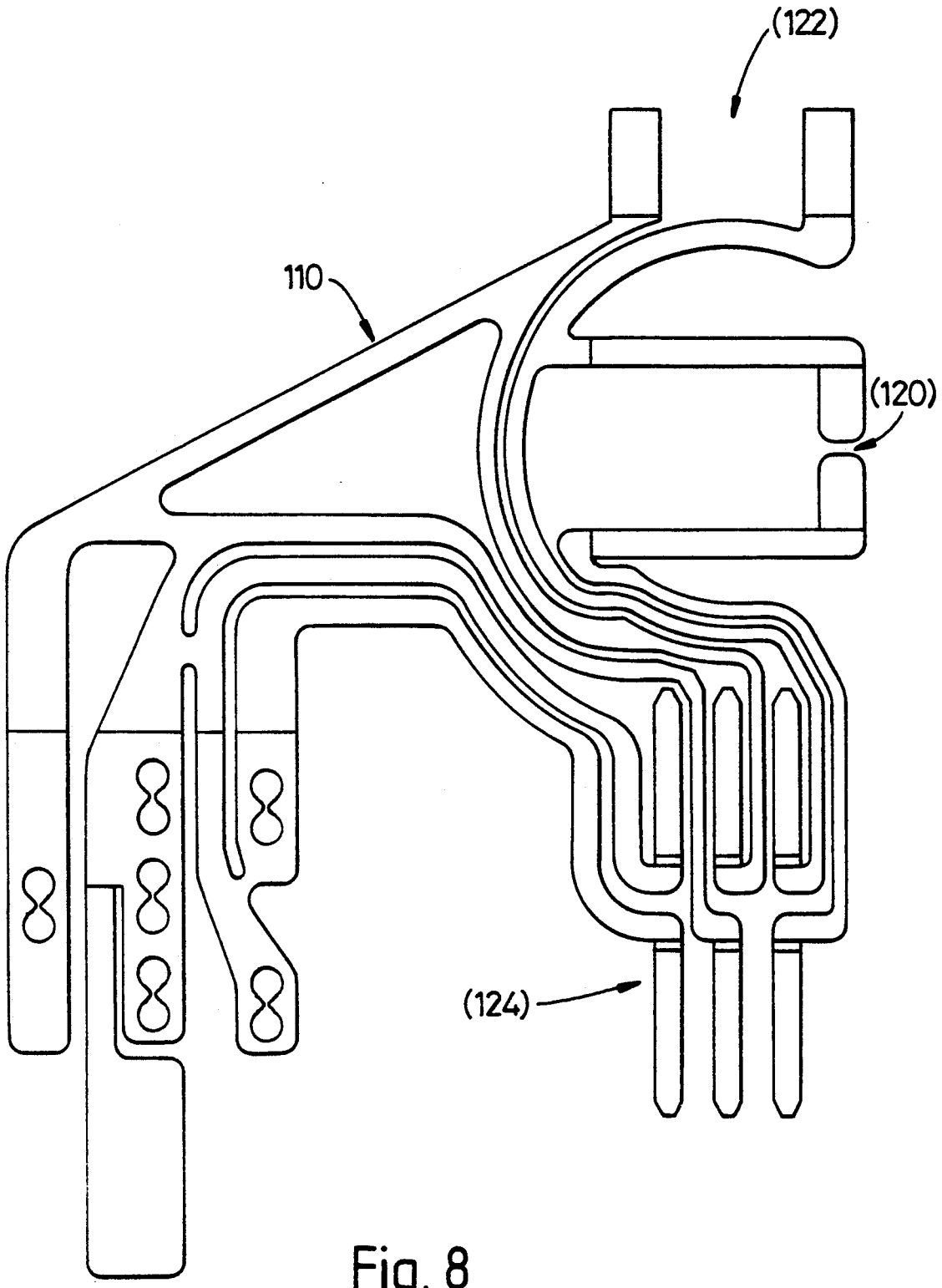
FIG. 8 is a plan view of an electrical circuit stamping prior to incorporation in a body moulding of the latch.

The outer moulding 16 has an electrical circuit integrated therewith by providing a unitary metal etching stamping or pressing 110 as shown for example in FIG. 8 including connecting tabs for the motors, integrated switches, and for forming part of a connecting socket receiving a plug-in connector providing all the external electrical connections to the latch. This pressing is moulded into the moulding 16 and the connecting tabs etc are shaped as appropriate for mating electrical connections to contacts of the locking motor 68 which is received in socket 120, the superlocking motor 92 which is received in socket 122 and said electrical connector which is received in socket 124. Apart from connections set forth above, the circuit pressing is encapsulated and insulated and protected by the plastics material of the moulding. In order to separate the leads of the circuit as may be required for the particular form of operation desired, bridging portions of the pressing are removed after moulding by pressing or drilling holes or otherwise removing parts at appropriately selected positions e.g. at some one or more of the positions shown as 1–6 in FIG. 8. This enables the electrical assembly of the latch to be completed by simple insertion of components without need for any loose wiring or soldering, not only are the electrical connections so provided much more reliable and durable but assembly and/or interchange of electrical components is greatly facilitated while keeping a compact construction and with some adaptability in providing variations in circuit connections without need for different components. For example, for some applications, the superlocking facility may not be required and/or some of the switches 48,100,104 described above may not be needed.

It is contemplated that certain electrical components of the circuit, e.g. resistors, could possibly be provided by being moulded into moulding 16 in conjunction with the circuit pressing or stamping described above.

The latch mechanism is preferably sealed against ingress of damp and dirt. Firstly the housing or chamber defined by shell 12 and cover 14 will be sealed at the joint between those components by provision of a suitable elastomeric or other gasket, or by providing integral flexible sealing lips or skirts.

Secondly, it is preferred that sealing of any pivot shafts and moving or other components extending through the walls of said chamber is provided by integral flexible sealing lips or skirts moulded integrally with the component concerned and/or integrally with the portion of the housing surrounding the pivot bearing aperture or the like. This eliminates the need for O rings or similar sealing elements, again substantially simplifying manufacture and assembly. The effective sealing of the latch mechanism means that the bearings of the motors and similar vulnerable parts of the mechanism, particularly the electrical components, need not themselves be sealed or protected, again reducing cost. Furthermore, it is contemplated that by selecting appropriate materials, notably plastics, possibly having a low friction and/or self-lubricating composition e.g. having a silicon content, lubrication might be largely dispensed with or significantly reduced, except possibly for use of lubricant-impregnated bearing bushes in such items as the motors. Elimination of or reduction in the need for oil and grease in vehicle door latches has substantial practical advantages. All lubricants inevitably deteriorate in time and this is particularly the case in vehicle components which are subjected to extremes of cold and heat. Lubricant attracts and holds dirt and grit and can therefore be a cause of substantially increased wear and tear. Use of selected plastics and plastics coated or faced components might provide acceptably quiet operation even without lubricant with only minimal application thereof.

While an external mechanical key cylinder type lock has been referred to above it is to be understood that the latch of the invention may be readily used in combination with other types of coded key or equivalent locks e.g. remote actuated infra red or like pulse coded locks, optical or card reading locks and the like.

Having now described my invention what I claim is:

1. A vehicle door latch assembly including retention mechanism having a latch bolt operatively co-acting with a door post striker for latching the door in use; locking mechanism selectively operable to lock and unlock the retention mechanism; a primary electric actuator linked for selective powered operation of the locking mechanism; electrical circuit means connected with said actuator; and a body structure locating the retention mechanism, the locking mechanism, the actuator, and the circuit means in their operative relationship and formed to accommodate one or more additional electrical components in operative connection with said circuit means, said body structure including a housing part containing at least the actuator, the circuit means, and any of said additional electric components for installation of the assembly as a single unit with all electric elements of the assembly substantially protected within said housing part; characterized in that said circuit means includes a metal circuit formation integrated into a component of said housing part by incorporation during molding of said component from plastics material, any electrical separation of parts of the circuit formation needed to adapt it to the combination of electrical components used in a particular assembly being provided by selective removal of one or more parts of the integrated component and circuit formation after molding.

2. An assembly as in claim 1 characterized in that said actuator and any additional said electric components have plug-in electrical connection with the circuit mean within the housing part.

3. An assembly as in claim 1 characterized in that one of said additional electric components comprises switching means responsive to predetermined conditions of one or more moving parts of said mechanisms or actuator.

4. An assembly as in claim 1 characterized in that one of said additional electric components comprises a secondary electric actuator selectively operable for setting the mechanisms in a superlocked condition at which moving parts of the mechanisms are positioned to prevent unlocking of the retention mechanism by attempted displacement of actuating connections to the assembly in use.

5. An assembly as in claim 4 characterized in that the secondary actuator is selectively energizable to set the mechanism in said superlock condition to which it is operatively driven by operation of the primary actuator the secondary actuator operating to shift a blocking element to a disengaged position to free the mechanism for said operation.

6. An assembly as in claim 4 characterized in that the locking mechanism is so arranged that when put into the superlocked condition a said manual actuating connection outside the assembly is rendered inoperative to preclude unlocking of the latch but is left free for displacement through its normal range of movement.

7. An assembly as in claim 1 wherein the locking mechanism is selectively manually actuable by the insertion and operation of a key characterized in that the assembly includes a said additional electrical component being key position responsive switching means operating in said circuit means in response to operation by said key.

8. An assembly as in claim 1 characterized in that the housing part further substantially encloses at least a major part of the retention and locking mechanisms.

9. An assembly as in claim 8 characterized in that the body structure is formed from one or more plastics mouldings incorporating integral flexible sealing skirts around pivot shafts and joints for sealing the housing without need for separate seals and gaskets.

10. An assembly as in claim 1 wherein the retention assembly latch bolt is rotatable to and from a latched condition, said retention mechanism further including a retention pawl for releasably retaining the bolt in said latched condition; characterized in that the remainder of the retention mechanism has lost motion connection with the pawl whereby said remaining part of the mechanism is not displaced during movement of the pawl as latching takes place.

11. An assembly as in claim 10 characterized in that the retention mechanism further includes a resiliently loaded claw position lever coacting with the bolt to bias the bolt for positive engagement with the retention pawl.

12. An assembly as in claim 11 characterized in that the assembly includes a said additional electrical component being a bolt position switch actuated by movement of the bolt position lever to provide a signal indicative of the bolt position.

* * * * *